US005242156A

United States Patent [19]

Kay

[11] Patent Number: 5,242,156

[45] Date of Patent: Sep. 7, 1993

[54] DUAL BELT FURNACE

[75] Inventor: John R. Kay, Niagara Falls, Canada

[73] Assignee: Can-Eng Holdings, Ltd., Canada

[21] Appl. No.: 863,066

[22] Filed: Apr. 3, 1992

[51] Int. Cl.[5] ..... C21D 1/06

[52] U.S. Cl. ..... 266/105; 266/249; 266/252; 432/243

[58] Field of Search ..... 266/249, 252, 279, 105; 432/253, 239, 243, 121, 140

[56] References Cited

U.S. PATENT DOCUMENTS 1,776,117 9/1930 Heames et al. ..... 266/252
2,615,701 10/1952 Ipsen ..... 266/252

FOREIGN PATENT DOCUMENTS 0148702 11/1980 Japan ..... 266/252

OTHER PUBLICATIONS

*Surface Standard Rated Continuous Belt Furnaces,* Bulletin SC-197-467-20M-BK, Midland-Ross Corp. Dec. 1967 pp. 1-8.

*Primary Examiner*—Scott Kastler

*Attorney, Agent, or Firm*—Davis Chin

[57] ABSTRACT

A dual belt furnace for heat-treating of small parts includes enclosure having a base, a pair of side walls, a top wall, front wall, and a rear wall all being connected together to form at least one heating zone. A plurality of gas burners are positioned throughout the enclosure for delivering a hot gaseous medium. A plurality of fans are mounted in the top wall of the furnace for circulating the heated gas medium within the enclosures. A first conveyor belt is arranged completely within the at least one heating zone and extends substantially between the front wall and the rear wall of the enclosure for transporting the small parts to be heat treated through the at least one heating zone to a drop zone. The second conveyor belt extends beyond the at least one heating zone and overlays the first conveyor belt so as to be supported by the first conveyor belt within the at least one heating zone for carrying the small parts to be heat treated into the at least one heating zone. Consequently, the dual belt furnace has a high load-carrying capacity for small parts but yet is high energy efficient which has been traditionally unavailable heretofore.

20 Claims, 2 Drawing Sheets

DUAL BELT FURNACE

BACKGROUND OF THE INVENTION

1. Field of the Invention

This invention relates generally to furnaces for heat treating of metal parts or materials and more particularly, it relates to a dual belt furnace which includes a finely woven wire-mesh belt for carrying small metal parts between the entrance end and the exit end of the furnace and a cast link belt of a high load-carrying capacity for supporting the wire-mesh belt within the heating zones of the furnace.

2. Description of the Prior Art

In the heat treatment of high-precision, high finish small metal parts, it is a general requirement that the metal be softened part way through the process so as to enable further processing of the metal parts. Traditionally, it has been the practice heretofore in the heat treatment of various metal parts to use a process referred to as "batch handling." In this batch handling process, the metal parts were packed with the usual carburizing compound in cast-metal pots or drums. The drums were then placed in a furnace and heated to and held at the desired carburizing temperature for the requisite time. After the expiration of the appropriate time interval, the drums were removed from the furnace and dumped and allowed to cool before they were re-packed. This process required the use of a number of laborers, for example, one to re-pack the cold drums, one to remove the drums from the furnace, one to dump the contents of the drum into a sieve for separating any medium from the metal parts, etc. As a result of the foregoing, there have a been a series of developments beginning from the earliest days of this century which are aimed at eliminating the need for this costly batch handling, thereby improving the manner in which the metal parts can be heat treated in a furnace.

A first type of heat-treating systems developed to replace the relatively primitive batch-style furnaces were rotary retort furnaces. The rotary retort furnace includes a cylindrical retort having dimensions of approximately 30 inches in diameter and 15 feet in length. The cylindrical retort is arranged so that the heat can be externally supplied, while the retort itself can be rotated about a longitudinal axis. Within the retort, there is provided a spiral flight or guide-fence, approximately 3 inches in height, which is attached to the wall at one edge. As the retort is rotated, the parts within the retort will be driven along length as by an auger. The parts are thus subsequently heated and as they reach the end of the retort, they are transferred to a liquid or gas quench environment.

While this heat-treating system has the advantage of providing a controlled atmosphere and being somewhat high energy efficient, it has limitations because only relatively small quantities can be conveyed through the retort furnace and throughput can only be increased by increasing the length of the retort. Further, as the parts are continually subjected to a tumbling action in which the parts are thrown against each other and against the spiral flights by operation of the retort, there is the obvious possibility of surface damage to the parts. Moreover, this problem becomes worse when the furnace is increasingly heavily loaded. Another problem associated with the tumbling action is that only units of one particular type of the part can be heat treated at a time, unless a costly sorting operation is performed afterwards.

A second type of heat-treating systems developed to replace the batch handling process were continuous conveyor furnace designs in which the parts are moved steadily through a heating chamber. In such furnace designs, the travel of the conveyor can be made to extend beyond the confines of the heating zone. Such a design permits the easy loading onto the conveyor at the input end of the furnace, and the easy delivery to a quench bath or other receiving station at the output end thereof.

Conveyor furnace technology has developed along three lines since those early years: First, there came the mesh belt conveyor furnace, in which a temperature-resistant metal wire is used to weave or otherwise construct the conveyor belt. This belt followed a more or less convoluted course, serving to pick up parts outside the input end of the furnace, carry them through the furnace for the required time, and deliver them to some receiving station at the output end. The belt also had to pass through the belt drive system, however this might be arranged.

Such a belt would often be carried between two parallel chains or cables; these items served to transmit the driving force as well as to provide mechanical support at the edges of the belt. Such a belt was ideal for small, light-weight parts and provided thermal efficiencies close to those of retort-type furnaces in that the belt itself, which must of necessity be subjected to continual heating up and cooling down as it enters and leaves the furnace, would have only a small thermal capacity. Because of the nature of the belt, there was also good circulation of atmosphere provided through the belt and thus around the parts.

For heavier and denser part loading, the mesh belt technology offered inadequate mechanical strength, particularly when it is considered that the belt must operate at elevated temperatures. In these cases, a second type of conveyor furnaces were designed in which the mesh of the belt was superseded by a relatively massive construction of cast links, interlocking with each other. Such a form of construction, while providing all the mechanical strength that could be desired, and while allowing circulation of the furnace atmosphere through the interstices between the links, suffered from an accompanying disadvantage in that the cast links had a relatively high thermal disadvantage in that the cast links had a relatively high thermal capacity. As the belt had to continually enter and leave the furnace in order to pick up and deliver parts, the result was a furnace of lower energy efficiency. This design was also ill-suited to small, high-density parts as these can fall into the interstices between the links, becoming lost or damaged in the process, and sometimes damaging the belt.

A third form of furnace construction, developed within the last decade, relied upon a series of plates, pans or buckets replacing the belts in the above-described designs. These buckets offered the particular facility of being able to dump their contents into any one of several receiving stations, or to continue to carry their contents to another furnace section if desired. The design thus had great flexibility, although the heat efficiency was generally poorer than for the mesh belt design. Further, insofar as parts would be heaped in the pans or buckets, there was an opportunity for considerable surface damage to occur, which was generally not the case in belt furnaces, where parts would usually be loaded in thin layers. Finally, this design was less conducive to good circulation of the furnace atmosphere around the parts.

It will be noted that none of these technologies is ideal for a production heat-treated situation requiring a high throughput of high-density parts whose surface finish is of the utmost importance to the success of the operation. The rotary retort has acceptable thermal efficiency but damages the parts at high throughputs; the mesh-belt has inadequate mechanical strength; the link-belt system has poor thermal efficiency and is ill-suited to the handling of small parts; and the bucket-conveyor design has a thermal efficiency almost as poor, and threatens to damage the parts as well, while restricting atmospheric circulation.

As a result, plants devoted to the production of small high-precision parts requiring a high surface finish without mechanical imperfections cannot find the ideal furnace for the heat treating of their product. As can be seen by the foregoing, every technology so far available presents one or more disadvantages from the viewpoint of heat treating such parts.

A state-of-the-art search directed to the subject matter of this application uncovered the following U.S. Pat. No.:

| | |
|---|---|
| 932,945 | 2,007,862 |
| 1,792,456 | 3,565,409 |
| 1,922,908 | 4,402,494 |

There is disclosed in U.S. Pat. No. 1,792,456 to Charles T. Willard and Richard Kaier issued on Feb. 10, 1931, a metal-treating furnace which includes a tubular retort disposed within a suitable heating chamber and an endless flexible wire-fabric belt-conveyor. The belt-conveyor runs over a loading platform and through the retort in contact with the continuous bottom wall of the platform and retort.

There is disclosed in U.S. Pat. No. 1,922,908 to Spencer A. Coleman issued on Aug. 15, 1933, an apron conveyor which is formed of sections of foraminous material such as a wire mesh or perforated sheet metal that may be conveniently assembled. The end portions of the foraminous sections are offset and project outwardly from the backside of the conveyor. Hinged members are secured to the offset portions. Stiffening plates are secured to the offset portions and the hinged members so as to provide a substantially continuous supporting surface.

In U.S. Pat. No. 2,007,862 to Alpheus O. Hurxtal issued on Jul. 9, 1935, there is taught a mesh screen conveyor which is formed of a series of screen sections. Each of the sections is comprised of relatively superimposed layers of fine mesh screening and a more coarse open mesh. The coarser mesh is used to provide support for the fine mesh screening when the conveyor is carrying a heavy load.

In U.S. Pat. No. 3,565,409 to Jacob H. Beck issued on Feb. 23, 1971, there is taught a conveyor system which is arranged to transport materials being treated through several zones of the furnace muffle. The conveyor includes a plurality of hinged trays attached to a movable link chain. The trays are arranged to either drop their contents into a quench bath or to convey their contents to an air-rich atmosphere depending upon the presence or absence of a removable bridge section. The chain passing through the furnace muffle is supported in a horizontal material-retaining position by the floor of the muffle. The link chain includes spaced-apart link members, each pair of link members being pivotally connected to a like pair of adjacent members by pivot rods. The tray is pivotally mounted on the pivot rods for retaining the materials to be treated.

The remaining patents listed above but not specifically discussed are believed to be of only general interest and show the state of the art in furnaces for heat treatment of materials.

However, none of the prior art uncovered in the search disclosed a dual belt furnace like that of the present invention which includes a wire-mesh belt for carrying small metal parts and a cast link belt of a high load carrying capacity for supporting a mesh belt within the heating zones of the furnace.

SUMMARY OF THE INVENTION

Accordingly, it is a general object of the present invention to provide a dual belt furnace for heat-treating small parts which is relatively simple and economical to manufacture and assemble, but yet overcomes all of the disadvantages of the prior art furnaces.

It is an object of the present invention to provide a dual belt furnace for heat-treating of small parts which has a high load-carrying capacity, but yet is high energy efficient.

It is another object of the present invention to provide a dual belt furnace which includes a wire-mesh belt for carrying small metal parts between the entrance end and the exit end of the furnace and a cast link belt of a high load carrying capacity for supporting the wire-mesh belt within the heating zone of the furnace.

It is still yet another object of the present invention to provide a dual belt furnace which includes a preheat section for recapturing outgoing heat from the wire-mesh belt to preheat the incoming parts.

In accordance with these aims and objectives, the present invention is concerned with the provision of a dual belt furnace for heat-treating of small parts which includes an enclosure formed of a base, a pair of side walls, a top wall, a front wall, and a rear wall all being connected together to define at least one heating zone. A plurality of heaters are positioned throughout the enclosure for delivering a hot gaseous medium. A plurality of fans are mounted in the top wall of the furnace to circulate the heated gas medium within the enclosure. A first conveyor belt is arranged completely within the at least one heating zone and extends substantially between the front wall and the rear wall of the enclosure for transporting the small parts to be heat treated through the at least one heating zone to a drop zone. A second conveyor belt extends beyond the at least one heating zone and overlays the first conveyor belt so as to be supported by the first conveyor belt within the at least one heating zone for carrying the small parts to be heated into the at least one heating zone.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENT

Figure 1A:
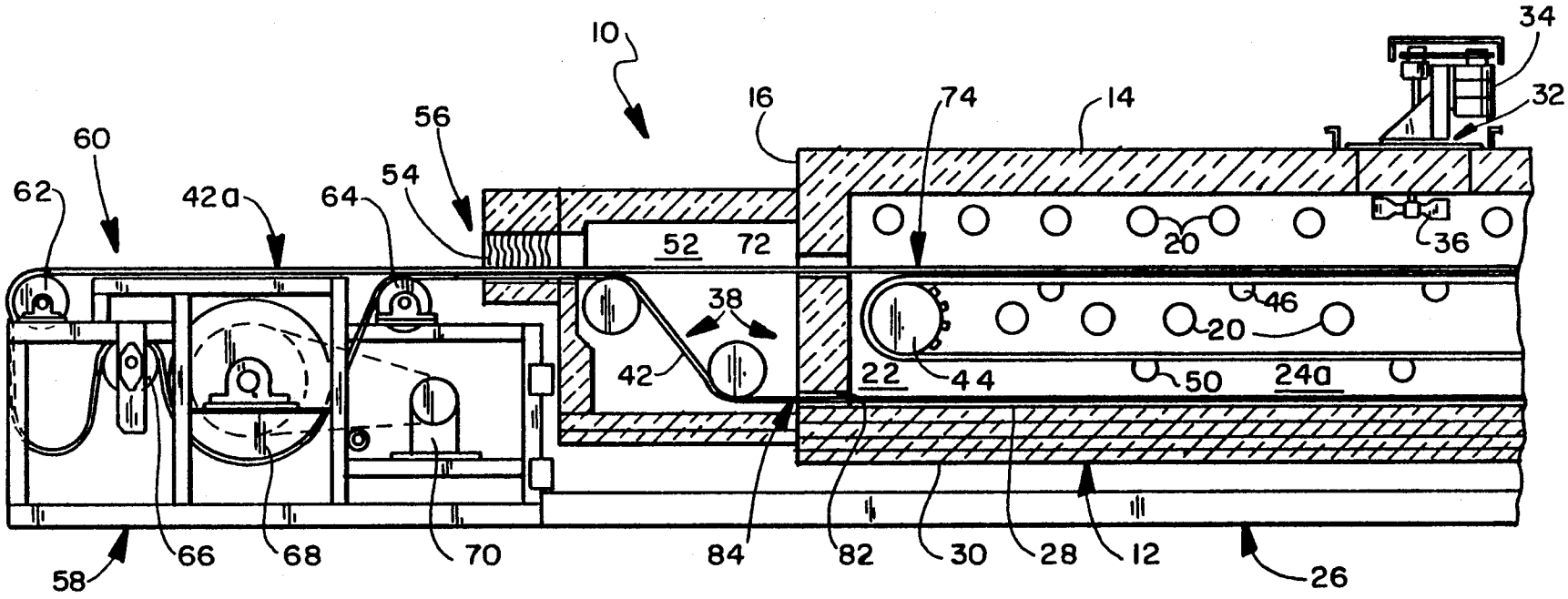
FIG. 1 is a longitudinal, sectional view of a dual belt furnace, constructed in accordance with the principles of the present invention.
Figure 2:
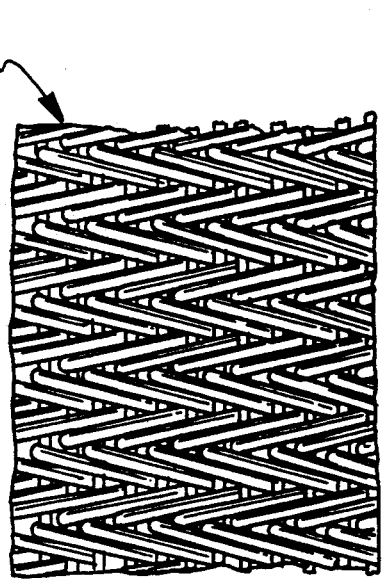
FIG. 2 is a top plan view of a portion of a finely woven wire-mesh conveyor belt suitable for use in the furnace of FIG. 1.
Figure 3:
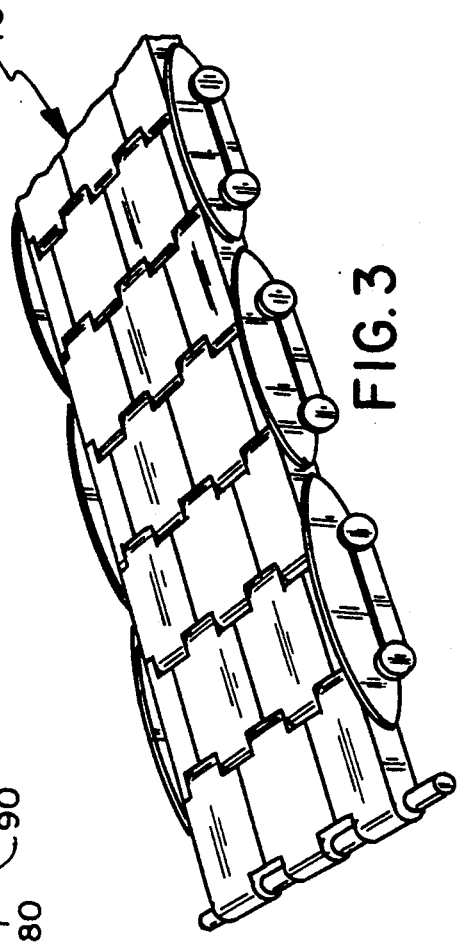
FIG. 3 is a top plan view of a portion of a cast link conveyor belt suitable for use in the furnace of FIG. 1.
Figure 1B:
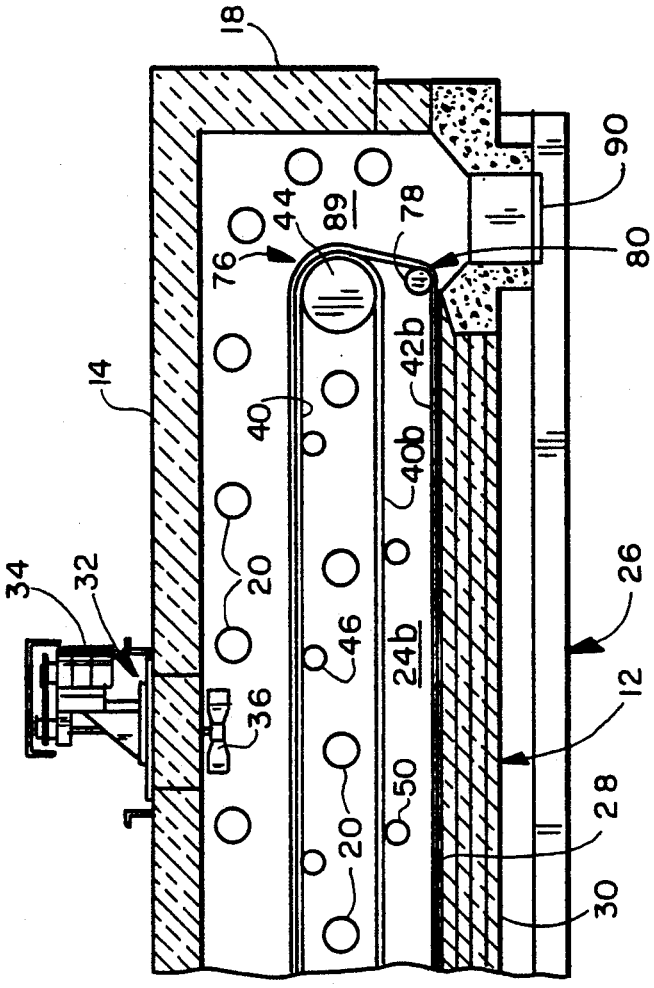

Referring now to the drawings and especially to FIG. 1, there is shown a dual belt furnace generally designated by reference numeral 10 and constructed in accordance with the principles of the present invention. The dual belt furnace 10 includes a base 12, a pair of side walls (not shown) connected to the base 12, a top wall 14 connected to the side walls, a front wall 16 connected to the base, the side walls, and the top wall, and a rear wall 18 connected also to the base, the side walls, and the top wall. A plurality of conventional gas burners 20 are positioned throughout an enclosure 22 defined by the top wall 14, side walls, base 12, front wall 16, and rear wall 18 for delivering a hot gaseous medium. In alternative embodiments, the enclosure 22 of the furnace may be heated by radiant tube gas fired heaters or electric heaters. The enclosure may be of a single heating zone or be divided into a plurality of heating zones designated respectively by reference numerals 24*a* and 24*b*.

It will be noted that base 12 may be supported by a plurality of I-beams (not shown) which rest on a surface 26. The base includes a floor 28 comprised of insulation and supported by an outer layer 30. In order to circulate the heated gas medium within the enclosure 22, there are provided a plurality of fans 32 mounted in the top wall 14 of the furnace. Each of the fans is driven by an electric motor 34 disposed above the top wall so as to rotate associated fan blades 36 to move the hot gaseous medium throughout the enclosure 22. While there is illustrated in the present embodiment of FIG. 1 a single fan for each of the heating zones, it should be clearly understood that any number of fans for each heating zone may be employed or alternatively, they may be eliminated entirely. Furthermore, the fans may be mounted instead on the side walls rather than on the top wall.

The materials, such as small metal parts or components to be heat-treated are moved through the furnace by means of a dual belt conveyor system 38 which includes an endless cast link belt 40 having a very high load-carrying capacity and an endless finely woven wire-mesh belt 42 for carrying the small parts. The cast link belt 40 is made of a high-strength material and is arranged to be completely positioned within the heating zone or zones 24*a* and 24*b* in the enclosure of the furnace. The cast link belt 40 is trained around a drive roller 44 adjacent the front wall 16 of the furnace and is then passed over a plurality of support rollers 46 to a return roller 48 located adjacent the rear wall 18 of the furnace. After running around and over the return roller 48, the return section of the cast link belt 40 is passed over a plurality of return rollers 50 and back to a drive roller 44.

Adjacent the outer end of the front wall 16, there is provided a preheat section 52 which includes a series of atmosphere-protecting curtains 54 located at an entry point 56 of the furnace for receiving and for preheating the incoming parts to be heat-treated prior to delivery of them into the heating zones. A drive and load table assembly 58 is provided in advance of the preheat section 52 in which the parts to be heat-treated are deposited onto the wire-mesh belt at loading point 60. The drive and load table assembly 58 includes support rollers 62 and 64, a pinch roller 66, a drive roller 68, and a drive unit 70 for driving the wire-mesh belt 42.

The wire-mesh belt 42 is preferably made of a finely woven mesh wire-fabric with a low thermal capacity which extends beyond the heating zone or zones through the preheat section 52 to the drive and load table assembly 58. In particular, the supply section 42*a* of the wire-mesh belt is passed over the support rollers 62 and 64 and is fed through the preheat section 52 to the heating zones 24*a* and 24*b* via an upper opening 72 formed in the front wall 16. As soon as the wire-mesh belt enters into the heating zones, where its own mechanical strength would be inadequate to support the load, the supply section is arranged to overlay the high-strength cast-link belt and to be supported by it between an initial contact point 74 and a drop-off point 76 near the rear wall 18. After running around a return roller 78 at separation point 80, the return section 42*b* of the wire-mesh belt is separated from the return section 40*b* of the cast link belt and is passed over the furnace floor towards a lower opening 82 formed in the front wall 16 at exit point 84.

The return section 42*b* is then raised by a lower roller 86 and an upper roller 88 so as to travel close and in parallel relationship to the supply section 42*a* adjacent the entry point 56. As a result, the return section 42*b* provides preheat for heating the supply section 42*a* of the wire-mesh belt and the parts loaded thereon at the loading point 60.

It should be understood that the cast link belt 42 is suitably driven independently by a separate mechanical drive mechanism not shown and well known in the art. However, the two drive mechanisms for the respective wire-mesh belt 42 and the cast link belt 40 are electrically interlocked so that they are synchronized to drive them at the same speed through the furnace. As the parts to be heat-treated reach the drop-off point 76, the parts carried on the wire-mesh belt 42 and supported by the cast link belt 40 will fall freely through a drop zone 89 into a liquid or gas quench environment (not shown) via an exit port 90.

A dual belt furnace of the present invention has the following advantages over the prior art:

a) It has a high energy efficiency since the high-strength cast link belt never exits the furnace heating zones and thus experiences no energy-wasted heat cycling other than the small excursions imposed by the arrival of the preheated parts;

(b) It has a high load-carrying capacity for small parts due to the wire-mesh belt being supported by the cast link belt within the heating zones while simultaneously preventing the parts from dropping through the interstices of the cast links;

(c) It has good atmospheric circulation due to the furnace gases being passed easily through the wire-mesh belt and through the interstices in the cast link belt; and (d) It has a preheat section for recapturing the outgoing heat from the wire-mesh belt to preheat the incoming parts.

From the foregoing detailed description, it can thus be seen that the present invention provides a dual belt furnace which includes a finely woven wire-mesh belt for carrying small metal parts between the entrance end and the exit end of the furnace and a cast link belt of a high load-carrying capacity for supporting the wire-mesh belt within the heating zones of the furnace. As a result, the dual belt furnace of the present invention has a high load-carrying capacity for small parts but yet is high energy efficient.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A dual belt furnace for heat-treating of small parts, comprising:

an enclosure having a base, a pair of side walls, a top wall, a front wall and a rear wall all being connected together to form at least one heating zone;

means for heating said enclosure by heating a gaseous medium therein;

means for moving said gaseous medium within said enclosure;

a first conveyor belt arranged completely within said at least one heating zone and extending substantially between said front wall and said rear wall of said enclosure for transporting the small parts to be heat treated through said at least one heating zone to a drop zone; and a second conveyor belt extending beyond said at least one heating zone and overlaying said first conveyor belt so as to be supported by said first conveyor belt within said at least one heating zone for carrying said small parts to be heat treated into said at least one heating zone.

2. A dual belt furnace as claimed in claim 1, wherein said first conveyor belt comprises an endless cast link belt.

3. A dual belt furnace as claimed in claim 2, wherein said second conveyor belt comprises an endless finely woven wire-mesh belt.

4. A dual belt furnace as claimed in claim 3, further comprising a preheat section disposed adjacent the outer end of the front wall of the enclosure for preheating said small parts to be heat treated prior to delivery of said small parts into said at least one heating zone.

5. A dual belt furnace as claimed in claim 4, wherein a return section of said wire-mesh belt is disposed adjacent a supply section of said wire-mesh belt within said preheat section so as to preheat the supply section and the small parts to be heat treated.

6. A dual belt furnace as claimed in claim 4, wherein said preheat section includes a series of atmosphere-protecting curtains located at an entry point of the furnace.

7. A dual belt furnace as claimed in claim 4, further comprising a drive and load table disposed in advance of said preheat section for depositing said small parts to be heat treated onto said wire-mesh belt.

8. A dual belt furnace as claimed in claim 7, wherein said drive and load table includes means for driving said wire-mesh conveyor belt.

9. A dual belt furnace as claimed in claim 5, wherein said means for moving said gaseous medium within said enclosure comprises at least one fan mounted in said top wall of said enclosure.

10. A dual belt furnace for heat-treating of small parts, comprising:

an enclosure having a base, a pair of side walls, a top wall, a front wall and a rear wall all being connected together to form at least one heating zone;

means for heating said enclosure by heating a gaseous medium therein;

first conveyor belt means arranged completely within said at least one heating zone and extending substantially between said front wall and said rear wall of said enclosure for transporting the small parts to be heat treated through said at least one heating zone to a drop zone; and second conveyor belt means extending beyond said at least one heating zone and overlaying said first conveyor belt so as to be supported by said first conveyor belt within said at least one heating zone for carrying said small parts to be heat treated into said at least one heating zone.

11. A dual belt furnace as claimed in claim 10, wherein said first conveyor belt means comprises an endless cast link belt.

12. A dual belt furnace as claimed in claim 11, wherein said second conveyor belt means comprises an endless finely woven wire-mesh belt.

13. A dual belt furnace as claimed in claim 12, further comprising a preheat section means disposed adjacent the outer end of the front wall of the enclosure for preheating said small parts to be heat treated prior to delivery of said small parts into said at least one heating zone.

14. A dual belt furnace as claimed in claim 13, wherein a return section of said second conveyor belt means is disposed adjacent a supply section of said second conveyor belt means within said preheat section means so as to preheat the supply section and the small parts to be heat treated.

15. A dual belt furnace as claimed in claim 13, wherein said preheat section means includes a series of atmosphere-protecting curtains located at an entry point of the furnace.

16. A dual belt furnace as claimed in claim 13, further comprising drive and load table means disposed in advance of said preheat section means for depositing said small parts to be heat treated onto said second conveyor belt means.

17. A dual belt furnace as claimed in claim 16, wherein said drive and load table means includes means for driving said second conveyor belt means.

18. A dual belt furnace for heat-treating of small parts, comprising:

an enclosure having a base, a pair of side walls, a top wall, a front wall and a rear wall all being connected together to form at least one heating zone;

means for heating said enclosure by heating a gaseous medium therein;

a first conveyor belt arranged completely within said at least one heating zone and extending substantially between said front wall and said rear wall of said enclosure for transporting the small parts to be heat treated through said at least one heating zone to a drop zone; and a second conveyor belt extending beyond said at least one heating zone and overlaying said first conveyor belt so as to be supported by said first conveyor belt within said at least one heating zone for carrying said small parts to be heat treated into said at least one heating zone.

19. A dual belt furnace as claimed in claim 18, wherein said first conveyor belt comprises an endless cast link belt.

20. A dual belt furnace as claimed in claim 19, wherein said second conveyor belt comprises an endless finely woven wire-mesh belt.

* * * * *